United States Patent [19]

LeMieux et al.

[11] Patent Number: 4,609,774

[45] Date of Patent: Sep. 2, 1986

[54] ELECTRICAL TERMINAL CONSTRUCTION WITH FUSIBLE SECTION

[75] Inventors: David M. LeMieux, Coventry; John A. Dodenhoff, deceased, late of Cranston, Maxine S. Dodenhoff, executor; by Ralph Papitto, executor, Hope, all of R.I.

[73] Assignee: B & W Electronic Enclosures, Inc., Pawtucket, R.I.

[21] Appl. No.: 746,254

[22] Filed: Jun. 18, 1985

[51] Int. Cl.[4] ..... H01B 17/30; H01R 13/68; H01R 13/74

[52] U.S. Cl. ..... 174/152 GM; 337/1; 339/192 RL

[58] Field of Search ..... 174/152 GM; 337/1, 401, 337/405, 416, 417; 339/192 R, 192 RL

[56] References Cited

U.S. PATENT DOCUMENTS

| | | | |
|---|---|---|---|
| 3,988,053 | 10/1976 | Doenhoff | 174/152 GM X |
| 4,252,394 | 2/1981 | Miller | 174/152 GM X |
| 4,296,275 | 10/1981 | Bowsky | 174/152 GM |
| 4,461,925 | 7/1984 | Bowsky et al. | 174/152 GM |

*Primary Examiner*—Laramie E. Askin
*Attorney, Agent, or Firm*—Salter & Michaelson

[57] ABSTRACT

A terminal construction comprises a body having one or more apertures therethrough, a pin element in each of the apertures and a seal element in each of the apertures hermetically sealing and electrically insulating between the adjacent pin element and the body. Each of the pin elements comprises first and second pin sections and a fusible section which interconnects the first and second pin sections in substantially aligned relation at a point in the extent of the pin element where it is not bonded to the adjacent seal element. The fusible sections are made of a material having a melting point which is well below the softening point of the material from which the seal elements are constructed. Hence, when the terminal is operated under high temperature and/or electrical overload conditions wherein one or more of the terminals becomes overheated, the respective fusible sections of the overheated terminals are melted so that the pin sections thereby connected are separated to interrupt the flow of current through the terminal.

13 Claims, 4 Drawing Figures

ELECTRICAL TERMINAL CONSTRUCTION WITH FUSIBLE SECTION

BACKGROUND AND SUMMARY OF THE INVENTION

The instant invention relates to electrical terminals and more particularly to a terminal which can be effectively utilized for both hermetic and nonhermetic applications and which is operative for interrupting the flow of electrical current therethrough when it is operated under high temperature conditions such as caused by electrical overloads.

A number of different types of terminals have been heretofore available for use in transmitting electrical currents through the walls of both hermetic and nonhermetic housings containing electrical apparatus and/or circuitry. In this regard, hermetic terminals of this general type are disclosed and illustrated in the U.S. patents to DODENHOFF, U.S. Pat. Nos. 3,988,053, MILLER, 4,252,394, and BOWSKY, 4,296,275, which represent the closest prior art to the instant invention of which the applicants are aware. Hermetic terminals of the general type disclosed in these patents have been primarily utilized for passing electrical currents through the walls of hermetically sealed compressor housings, such as those which contain pressurized gases and/or liquids, and they have been generally mounted in openings in the walls of the housings for providing hermetic electrical communication between electrically conductive elements on the interiors and the exteriors of the housings. In any event, it has been found that since terminals of this type have frequently been used for passing currents through housings which contain pressurized gases, such as Freon, as well as other pressurized gases and/or liquids, it is important that they be constructed so that they maintain their structural integrity under all conditions.

While a number of the heretofore available electrical terminals of this general type have been found to be effective under normal operating conditions for providing electrical communication between the exteriors and interiors of housings, they have sometimes been less than entirely effective when they have been operated under high temperature conditions, such as caused by electrical overloads. In this regard, most of the heretofore available hermetic terminals of this type have comprised a cup-shaped body having one or more apertures therethrough, one or more elongated terminal pins which extend through the apertures, and one or more glass seal elements which electrically insulate and seal between the terminal pins and the body in the areas of the apertures. It has been found that in remote instances, such as under high temperature electrical overload conditions, one or more of the pins of a hermetic terminal of this type can become heated to the extent that the adjacent glass seal elements are melted. Although the chances of this occurring are extremely remote, when it does occur, the integrity of the seal provided by the terminal can be lost and gas and/or liquid contained in the interior of the housing can leak through the apertures in the terminal. Further, it has also been found that if the flow of electrical current through a terminal of this type is not somehow interrupted during electrical overload conditions, substantial damage can occur to the electrical apparatus and/or circuitry contained in the housing to which the terminal is connected.

The instant invention provides an improved terminal construction which can be effectively utilized for hermetic applications, such as for refrigeration compressor housings, and also for nonhermetic applications, and which has substantially improved reliability for maintaining its structural integrity under high temperature overload conditions. In this regard, the terminal construction of the instant invention comprises a body having an end wall with an aperture therethrough, a pin made of an electrically conductive material extending through the aperture in the end wall and a distance therebeyond on each side thereof, and an electrically insulating seal bonding the pin to the end wall. The pin has an inner end which is disposed on the inner side of the body and an outer end which is disposed on the outer side of the body and it comprises first and second pin sections and a fusible section which interconnects the two pin sections in substantially aligned relation at a point in the extent of the pin which is not bonded to the seal. The fusible section is made of a material having a melting point which is sufficiently less than the softening point of the material from which the seal is constructed so that when the pin is heated, the fusible section melts to permit the two pin sections to separate before integrity of the seal is lost. The terminal is preferably constructed so that the first pin section extends through the aperture, so that the seal is bonded to the first pin section and so that the fusible section is disposed between the seal and the inner end of the pin. Further, preferably the seal is made of glass and at least the first pin section is constructed of stainless steel so that an enhanced bond is provided between the pin and the seal. Preferably the second pin section is formed with a socket element on the end thereof which is connected to the fusible section and the fusible section and the adjacent end of the first pin section are received in the socket element. In addition, a substantially radially extending flange is preferably formed on the second pin section adjacent the end of the socket element and an electrically insulative disc is received on the pin between the flange and the body. In this regard, it has been found that when the terminal of the instant invention is constructed in this manner, the socket element and the flange facilitate the assembly of the two pin sections by maintaining them in substantially aligned relation while they are secured together with the fusible section.

As a result of the above features, the terminal construction of the instant invention effectively solves the problem of maintaining the integrity of the seal provided by a hermetic terminal, even when it is operated under high temperature conditions, such as caused by electrical overloads. In this connection, it has been found that in most cases, the first and second pin sections of the terminal of the instant invention effectively separate well before the temperature of the adjacent seal of the terminal reaches its softening point. As a result, the flow of current through the terminal is normally interrupted before the integrity of the seal provided by the terminal is lost and, in most instances, before electrically operated equipment connected to the terminal is destroyed.

Accordingly, it is a primary object of the instant invention to provide a terminal construction which can be utilized for both hermetic and nonhermetic applications and which is operative for interrupting the flow of current therethrough when it is operated under high temperature electrical overload conditions.

Another object of the instant invention is to provide a hermetic terminal, wherein the integrity of the seal provided by the terminal is normally maintained even when it is operated under high temperature electrical overload conditions.

A still further object of the instant invention is to provide a hermetic terminal comprising a body, a terminal pin having first and second pin sections which are interconnected in substantially aligned relation by a fusible section and a seal element which seals between the pin and the body, wherein the fusible section is made of a material having a melting point which is substantially less than the melting point of the seal element.

Other objects, features and advantages of the invention shall become apparent as the description thereof proceeds when considered in connection with the accompanying illustrative drawings.

DESCRIPTION OF THE DRAWING

In the drawings which illustrate the best mode presently contemplated for carrying out the present invention.

DESCRIPTION OF THE INVENTION

Figure 1:
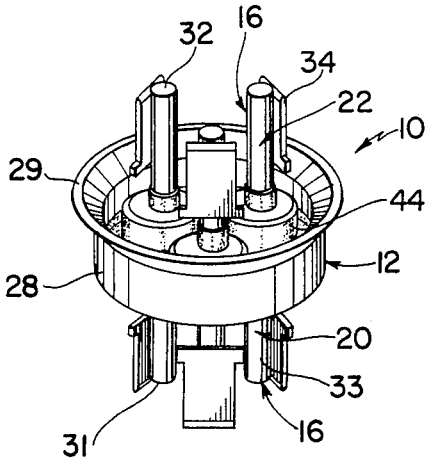
FIG. 1 is a perspective view of the hermetic terminal of the instant invention.
Figure 2:
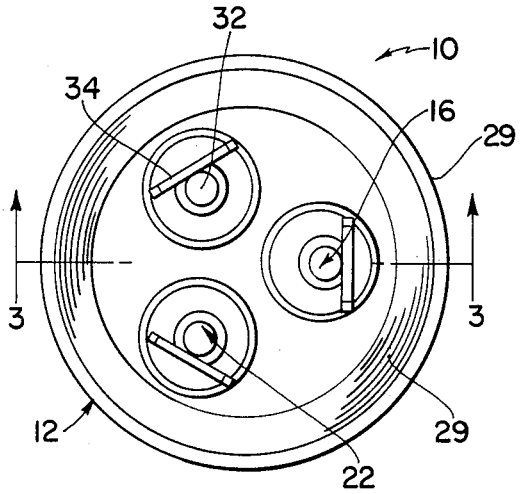
FIG. 2 is an enlarged plan view thereof.
Figure 3:
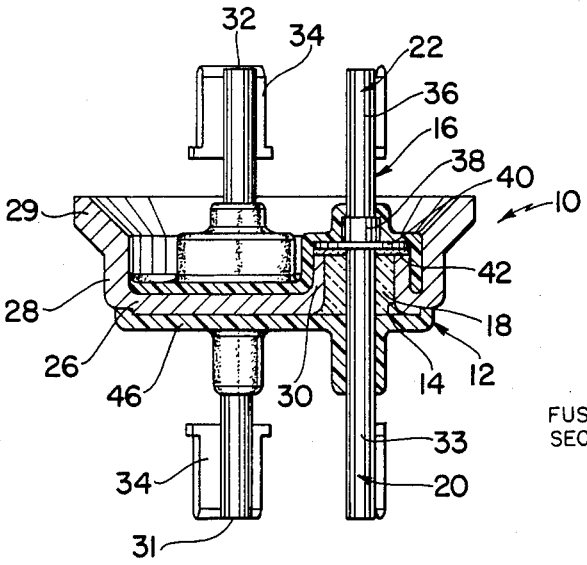
FIG. 3 is a sectional view taken along line 3—3 in FIG. 2.

Referring now to the drawing, the terminal of the instant invention which is herein embodied as a hermetic terminal, is illustrated and generally indicated at 10 in FIGS. 1 through 3. The terminal 10 comprises a body generally indicated at 12 having a plurality of apertures 14 therethrough, a plurality of pin elements generally indicated at 16 which extend through the apertures 14 in the body 12, and a plurality of glass seal elements 18 which seal and electrically insulate between the pin elements 16 and the body 12 in the areas where the pin elements 16 pass through the apertures 14. The pin elements 16 each comprise first and second pin sections generally indicated at 20 and 22, respectively, and a fusible section 24 which interconnects the pin sections 20 and 22 thereof in substantially aligned relation. The terminal 10 is constructed so that it is responsive to high temperature conditions, such as caused by electrical overloads, for interrupting the flow of electrical current through one or more of the pin elements 16 thereof before the integrity of the hermetic seal provided by the terminal 10 is destroyed. Accordingly, when the terminal 10 is utilized for a hermetic application, such as for passing currents through a hermetic compressor housing, and it is operated under high temperature overload conditions, the terminal 10 is operative for interrupting the flow of electrical current to the compressor before gases or liquids can leak from the housing thereof through the terminal 10.

The body 12 is preferably made of carbon steel in a dish-shaped configuration and it is preferably plated with autocatalytic nickel for enhanced resistance to corrosion. The body 12 preferably comprises a substantially circular end wall 26 through which the apertures 14 extend, a peripheral side wall 28 which preferably extends in generally perpendicular relation from the end wall 26, and an outwardly flared rim 29 which extends from the side wall 28 and cooperates therewith and with the end wall 26 for defining a generally dish-shaped configuration in the body 12. A plurality of circular lips 30 are formed in the body 12 so that they extend from the end wall 26 around the perimeters of the apertures 14 into the interior area of the body 12.

Figure 4:
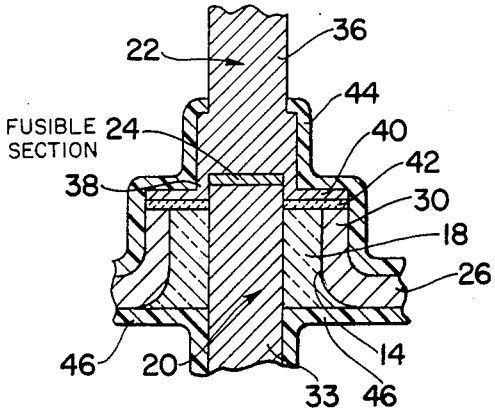
FIG. 4 is a further enlarged fragmentary sectional view which illustrates the interconnection between a pair of the pin sections thereof.

The pin elements 16, which each comprise a first pin section 20, a second pin section 22, and a fusible section 24, are most clearly illustrated in FIGS. 3 and 4. As will be seen, the first pin section 20 of each pin element 16 defines an outer end 31 thereof, whereas the second pin section 22 defines an inner end 32 thereof. Each of the first pin sections 20 preferably comprises a substantially straight conductor element 33 and a connector tab 34 which is secured to the element 33 by suitable means, such as by welding or brazing. The conductor element 33 is preferably made of stainless steel, because it has been found that stainless steel can be effectively bonded to the seal element 18 when the seal element 18 is made of glass. Specifically, it has been found tht the chromium oxide layer which is naturally present on the surfaces of the conductor element 33 when it is made of stainless steel, enhances the bonding characteristics between the conductor element 33 and the seal element 18 when the seal element 18 is made of glass. Further, it has been found that when the seal element is made of glass and the conductor element 33 is made of a material, such as stainless steel, having a thermal expansion coefficient which is slightly less than the expansion coefficient of glass, an even further enhanced bond between the conductor element 33 and the adjacent seal element 18 is achieved.

The second pin section 22 is preferably made of a conductive metal, such as steel or stainless steel, and it preferably comprises an elongated substantially straight conductor element 36, an electrical connector tab 34 which is preferably secured to the conductor element 36 by welding or brazing, a socket portion 38 which is formed on an end of the conductor element 36, and a flange portion 40 which extends substantially radially outwardly from the socket portion 38. The socket portion 38 and the flange portion 40 which are provided on the pin section 22 to maintain it in assembled relation with the first pin section 20 during the assembly of the pin element 16, are preferably integrally formed with the conductor element 36 at the end of the second pin section 22 which is opposite from the inner pin end 32 and the flange portion 40 is preferably integrally formed with the socket portion 38, as illustrated in FIGS. 3 and 4. In this regard, however, the socket portion 38 is preferably constructed so that the depth thereof is sufficient to facilitate the assembly of the two pin sections 20 and 22, without impeding their separation when their respective fusible section 24 is melted. Further, other embodiments of the pin element 16 wherein the second pin section 22 is formed without a socket in the end thereof and wherein the interconnected ends of both of the pin sections 20 and 22 are formed with enlarged circular flanges to provide increased bonding surface area for the fusible section 24 are contemplated.

The fusible sections 24 are received in the socket portions 38 of their respective pins 16 and they are operative for securing the first and second pin sections 20 and 22, respectively, together in substantially aligned end-to-end relation. Each of the fusible sections 24 is made of an electrically conductive material having a melting temperature which is less than the softening temperature of the material from which the adjacent seal element 18 is constructed. In this regard, although it has been found that a number of materials are available in this general category, such as various alloys, solders, and electrically conductive polymers and epoxies, a brazing alloy comprising approximately 90% lead, 5% silver, and 5% indium, which has a melting temperature in the range of between 554° F. and 590° F., has been found to be preferable and can be effectively utilized for the fusible sections 24.

Each of the seal elements 18 is constructed of a sealing material having a softening temperature which is substantially higher than the melting temperature of the adjacent fusible section 24. In this regard, the seal elements 18 are preferably made of a nonconductive material, such as a glass or a ceramic material, although it has been found that a glass having a softening point in the range of 1240° F. and a working point in the range of 1620° F. is preferable and can be effectively utilized in the terminal of the instant invention. The seal elements 18 are bonded to the inner surfaces of the adjacent lips 30 of the body 12 in the apertures 14 and also to the conductor elements 33 of the first pin sections 20 to provide effective hermetic seals in the terminal 10, which also electrically insulate the pins 16 from the body 12.

Also included in the terminal 10 are electrically insulative substantially flat circular apertured discs 42 which are received on the inner ends of the first pin sections 20 so that they are interposed between the adjacent flanges 40 and the adjacent lips 30 to electrically insulate the flanges 40 from the base 12. The discs 42 are preferably made of a material such as alumina and preferably the pin elements 16 are assembled in the body 12 and retained by the seal elements 18 so that the discs 42 are retained in engagement with both the adjacent flanges 40 and the adjacent lips 30 as illustrated most clearly in FIG. 4.

The preferred embodiment of the terminal 10 further comprises an epoxy coating 44 on the outer surfaces of the socket elements 38, the flanges 40, the discs 42 and the lips 30 and the inner surface of the wall 26 as illustrated most clearly in FIG. 3. In addition, a similar epoxy coating 46 is preferably provided on the exposed outer surface of the body wall 26, the outer surfaces of seal elements 18 and the portions of the first pin sections 20 which are adjacent the wall 26. The epoxy coatings 44 and 46 are provided for enhanced electrical insulation between the pin elements 16 and the body 12 in the areas where the pin elements 16 pass through the body 12.

For use and operation of the terminal 10, it is preferably assembled on a housing, such as the housing of a hermetic refrigeration compressor, so that the first pin sections 20 project outwardly from the housing and the second pin sections 22 project inwardly into the interior of the housing. The connector tabs 34 on the pin elements 16 are then electrically connected to appropriate connectors of complementary configurations for supplying electrical current to the compressor through the pin elements 16. In the event of a malfunction in the compressor, which causes excessive amounts of current to be drawn through the pin elements 16 so that the pin elements 16 become overheated, the terminal 10 interrupts the flow of current to the compressor before the integrity of the seal provided by the terminal 10 is lost. Specifically, when one of the pin elements 16 is overheated, the fusible section 24 thereof melts to permit the first and second pin sections 20 and 22, respectively, of the pin element 16 to be separated before the material from which the adjacent seal element 18 is constructed is heated to its softening point by the pin element 16. In this regard, in most applications, the terminal 10 is mounted so that the wall 26 of the body 12 is vertically disposed and hence the pin elements 16 are generally mounted in horizontal dispositions. Accordingly, when one of the fusible sections 24 is melted, the forces of gravity tend to cause the adjacent second pin section 22 to separate from its respective first pin section 20. As soon as the two pin sections 20 and 22 have been separated in this manner, the flow of electrical current through the pin element 16 is permanently interrupted. However, because the melting temperature of the fusible element 24 is reached well before the softening temperature of the adjacent seal element 18, the hermetic seal provided by the terminal 10 is not normally ruptured so that gases cannot normally leak from the housing through the terminal 10. Further, the flow of electrical current through the terminal 10 to electrical equipment contained in the housing is interrupted in order to reduce damage to the equipment.

It is seen therefore that the instant invention provides a terminal construction which can be effectively utilized in both hermetic and nonhermetic applications. The terminal 10 is effectively operative for interrupting the flow of current therethrough under most high temperature and/or electrical overload conditions. Further, when the terminal 10 is utilized in a hermetic application, it is also operative for maintaining the integrity of a seal in the wall of a housing despite the occurrence of a high temperature and/or an overload condition. Hence, it is seen that the terminal of the instant invention represents a significant advancement in the art which has substantial merit from both commercial and safety standpoints.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. In a terminal construction comprising a body having inner and outer sides and having an end wall with at least one aperture therethrough, a pin made of an electrically conductive material extending through said aperture in said end wall and extending a distance beyond said end wall on both sides thereof, said pin having inner and outer ends, the inner end of said pin being disposed on the inner side of said body, the outer end of said pin being disposed on the outer side of said body, a seal bonding said pin to said end wall, the improvement comprising said pin comprising first and second pin sections and an electrically conductive fusible section, said seal being bonded to said first pin section, said fusible section being disposed on the inner side of said body and interconnecting said first and second pin sections in substantially aligned relation at a point in the extent of said pin which is not bonded to said seal, said first and second pin sections being made of materials having melting points which are greater than the melting point of the material from which said seal is constructed, said fusible section being constructed and being made of a material having a melting point which is sufficiently less than the softening point of the material from which said seal is constructed so that when said pin is heated by the passage of current therethrough, said fusible section is melted to permit the separation of said first and second pin sections before said seal material is heated by said pin to its softening temperature.

2. In the terminal of claim 1, said seal further characterized as a glass seal.

3. In the terminal of claim 1, said seal further characterized as a ceramic seal.

4. In the terminal of claim 1, said first pin section defining the outer end of said pin, said second pin section defining the inner end of said pin, said second pin section having a flange thereon which extends substantially radially outwardly adjacent said fusible section, said terminal further comprising an electrically insulative disc on said first pin section interposed between said flange and said end wall.

5. In the terminal of claim 4, said disc further characterized as being mounted on said first pin section so that it is in engagement with said flange.

6. In the terminal of claim 4, said end wall having a lip formed thereon which extends around the perimeter of said aperture on the inner side of said end wall, said disc further characterized as being interposed in engagement with said flange and said lip.

7. In the terminal of claim 1, said first pin section comprising stainless steel.

8. In the terminal of claim 1, said fusible section comprising approximately 90% lead, 5% silver, and 5% indium.

9. In the terminal of claim 1, said fusible section having a melting point in the range of between 554° F. and 590° F.

10. In the terminal of claim 9, said seal having a softening point of approximately 1620° F.

11. In the terminal of claim 1, said seal having a softening point of approximately 1620° F.

12. In a terminal construction comprising a body having inner and outer sides and having an end wall with at least one aperture therethrough, a pin made of an electrically conductive material extending through said aperture in said end wall and extending a distance beyond said end wall on both sides thereof, said pin having inner and outer ends, the inner end of said pin being disposed on the inner side of said body, the outer end of said pin being disposed on the outer side of said body, a seal bonding said pin to said end wall, the improvement comprising said pin comprising first and second pin sections and an electrically conductive fusible section interconnecting said pin sections in substantially aligned relation at a point in the extent of said pin which is not bonded to said seal, one of said first or second pin sections having a substantially axial socket in one end thereof, said fusible section and the adjacent end of the other of said first or second pin sections being disposed in said socket, said fusible section being made of a material having a melting point which is sufficiently less than the softening point of the material from which said seal is constructed so that when said pin is heated, said fusible section melts to permit the separation of said pin sections before said seal material is heated by said pin to its softening temperature.

13. In a terminal construction comprising a body having inner and outer sides and having an end wall with at least one aperture therethrough, a pin made of an electrically conductive material extending through said aperture in said end wall and extending a distance beyond said end wall on both sides thereof, said pin having inner and outer ends, the inner end of said pin being disposed on the inner side of said body, the outer end of said pin being disposed on the outer side of said body, a seal bonding said pin to said end wall, the improvement comprising said pin comprising first and second pin sections and an electrically conductive fusible section interconnecting said pin sections in substantially aligned relation at a point in the extent of said pin which is not bonded to said seal, said first pin section extending through said aperture in said end wall, said fusible section being disposed between said seal and said pin inner end, said first pin section defining the outer end of said pin, said second pin section defining the inner end of said pin, said second pin section having a flange thereon which extends substantially radially outwardly adjacent said fusible section, said terminal further comprising an electrically insulative disc on said pin interposed between said flange and said end wall, said second pin section having a substantially axial socket in the end thereof opposite said pin inner end, the end of said first pin section opposite said pin outer end being received in said socket, said fusible section being disposed in said socket, said fusible section being made of a material having a melting point which is sufficiently less than the softening point of the material from which said seal is constructed so that when said pin is heated, said fusible section melts to permit the separation of said pin sections before said seal material is heated by said pin to its softening temperature.

* * * * *